US005987771A

United States Patent [19]

Curtin

[11] Patent Number: 5,987,771

[45] Date of Patent: Nov. 23, 1999

[54] SCENT CHARGED AERATION CAPSULE ASSEMBLY FOR HAIR BLOWER

[76] Inventor: Jason Quinn Curtin, 5506 N. Cook St., McFarland, Wis. 53558

[21] Appl. No.: 08/985,819

[22] Filed: Dec. 5, 1997

[51] Int. Cl.[6] ..... A45D 24/00

[52] U.S. Cl. ..... 34/97

[58] Field of Search ..... 34/283, 60, 96, 34/97; 392/380, 385; 132/108, 271

[56] References Cited

U.S. PATENT DOCUMENTS

| | | | |
|---|---|---|---|
| 1,727,212 | 9/1929 | Martin . | |
| 4,195,416 | 4/1980 | Hall | 34/90 |
| 4,383,377 | 5/1983 | Crafton | 34/60 |
| 4,523,080 | 6/1985 | Bolton | 219/362 |
| 4,835,879 | 6/1989 | Egelstad | 34/97 |
| 5,261,426 | 11/1993 | Kellett et al. | 132/108 |
| 5,490,336 | 2/1996 | Smick et al. | 34/97 |
| 5,572,800 | 11/1996 | West | 34/97 |

FOREIGN PATENT DOCUMENTS

| | | | |
|---|---|---|---|
| 874518 | 6/1971 | Canada | 34/97 X |

*Primary Examiner*—Henry Bennett
*Assistant Examiner*—Steve Gravini
*Attorney, Agent, or Firm*—Loyd W. Bonneville

[57] ABSTRACT

A scent charged aeration capsule assembly emplaced over the effluxive end of a hair blower whereby, during the blower's operation, a selected fragrance may directed into a subject's hair. Alternatively, a hair blower manufactured or modified to comprise a pad emplacement chamber permitting emplacement of a fragrance impregnated pad therein.

11 Claims, 6 Drawing Sheets

SCENT CHARGED AERATION CAPSULE ASSEMBLY FOR HAIR BLOWER

BACKGROUND OF THE INVENTION

1. Field of the Invention

Hair care accessories; pet supplies

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term pad compression plate (29) might be used in one instance but in another, if meaning is otherwise clear from context, expression might be shortened to compression plate (29) or merely plate (29). Any of those forms is intended to convey the same meaning.

The term emplace or any of its forms when used in this application means the joining of two objects or parts so as to unite them in a reasonably easily removable way, such as the positioning of a pad (20) within the pad emplacement chamber (3) within a nozzle duct (2), from which it (20) may be removed, discussed ante. The word emplace is also consistent in meaning with the word "detachable" as occasionally used in connection parlance but not in this application, since it is derived from the root attach. The term attach or fasten or any of their forms when so used means that the juncture is of a more or less permanent nature, such as might be accomplished by nails, screws, welds or adhesives. Employment of the words connect or join or any of their forms is intended to include the meaning of both in a more general way.

Certain specific objectives or needs are prevalent in today's world. There is a continuing requirement to remove objectionable odors from the air in many places, public or private. In commercial circles concerning hair care, or even at home, there frequently exists the desire to add a scent to one's hair after cleaning. Such devices are also beneficial for use with pets, particularly dogs, in imparting a fresh scent or disinfectant to its fur.

Yet, a mechanism designed to meet such needs and objectives should not be fraught with the hazard of ignition of the vapor employed. The drying and scenting tools used for such purpose should also be conveniently hand-held in the manner permitted by the common hair blower. To the extent practicable, the fragrance should be confined to its intended target. The sources of fragrance should also be conveniently interchangeable so that the operator may switch from one scent to another to quickly address the wishes of each customer. It would also be environmentally beneficial if the sources of fragrance could be easily disposed of after exhaustion.

In recent decades, devices comprising a source of perfumed or freshened air intended for use in conjunction with a hair or other type of blower have made occasional appearances. U.S. Pat. No. 4,195,416 issued to Hall features means for stowage of a hair blower and air freshener or other desired fragrance inside a bathroom cabinet. The blower is operable by a timer or an operable electric switch outside of the cabinet and vented through the cabinet floor. Perfume or air freshener vapors are drawn from within the cabinet into the blower, thereby allowing the discharge to disperse into the room. U.S. Pat. No. 1,727,212 issued to Martin employs a blower with hollow ring attached to the exterior encasing a wick from which, upon becoming wetted from droplets of perfume, vapors are released and allowed to penetrate through a line of holes leading into the blower's air discharge. U.S. Pat. No. 4,383,377 issued to Crafton illustrates an electric hand blower dryer with a removable exterior compartment in which a deodorizing substance or wick may be emplaced, allowing perfumed or artificially freshened air to be drawn through the blower's discharged air. U.S. Pat. No. 4,523,080 issued to Bolton consists of a hair blower aerosol spray can combination, in which an operator can emplace the spray can into a receptacle carved into the blower with its own spray button linked to the blower's trigger. Depression of the trigger permits injection of the aerosol contents into the subject's hair with the blower's discharged air. U.S. Pat. No. 4,835,879 issued to Egelstad comprises a perfumed or air freshened pad assembly which attaches to the air discharging end of a hair blower.

All of the foregoing feature in common the objective of loading the blower's discharged air with a perfumed scent or a vaporous substance intended for masking or, perhaps, disinfecting, unwanted odors. Martin's efforts produced an early patent, 1929, comprising a device which was meritworthy in adding the vapor downstream from the heating element, thereby likely avoiding the hazard of accidental combustion. However, it appears unwieldy and unsuited for hand held use such as that a hairdresser or beauty operator would prefer. Its wick's placement is relatively permanent and inaccessible for substitution or disposal. The fragrance source is somewhat remote from the airflow, limiting the efficiency of its intended use. Moreover, until the perfume bottle, the source of the vapor, is replaced—an inconvenient task—it is limited to a single fragrance. The Bolton, Hall and Crafton devices draw the vapor into the blower upstream of the heating element and do not, therefore, forestall the potential danger of ignition. Such hazards may be obviated with auxiliary switches but are not fail-safe from human error. Bolton's device also requires modification of the blower and presents the cumbersome assembly of an aerosol can extending outwards from the blower. Hall's and Crafton's amount to fixtures of sorts which do not permit operator hand held use. The airstream is dispersed throughout a room and their devices are not configured to permit convenient focusing upon a subject's hair. The Egelstad device does more than the others to meet the contemplated objectives. As is the case with Martin's, the vapor is added downstream from the heating element. No modification is required to the blower, which is employed in hand-held operation. In comprising a scented pad for a vapor source, it also goes far to meet the need for convenience in use. It fails to meet all of the objectives mentioned supra, however. Experience teaches that heated air has a deleterious effect upon adhesives. Further, in requiring attachment of the pad to the hair blower, particularly in view of the fact that attachment is by adhesion, the objective of convenient interchangeability is absent. Even if a first pad were removed and substituted for with a second one of different fragrance, it would be difficult to return to use of the first because, as common experience dictates, adhesives wear out quickly when reuse is attempted.

Many of the needs or objectives pointed out supra thus far remain only partly addressed in the prior art. Some have not been met at all.

SUMMARY OF THE INVENTION

The invention in most embodiments is a scent charged capsule assembly configured for emplacement upon the end of a hair blower and comprising a fragrance laden pad seated within a nozzle through which the blower's discharged air is ducted. Conventional operation of the blower thereby permits the scented airflow to impregnate a subject's hair. The scented pad is configured for facilitated emplacement within and removal from the device's airflow nozzle, permitting interchangeability of any one of a number of differently scented species thereof. Upon exhaustion of the perfume therein, the pad either may be discarded and replaced or, if convenient means for doing so are provided for, may be recharged for further use. One embodiment of the invention dispenses with a separate nozzle, comprising merely the cutting of an emplacement chamber into the blower itself.

BRIEF DESCRIPTION OF THE DRAWINGS

Solid lines in the drawings represent the invention. Dashed lines represent prior art.

FIGS. 1, 2 and 4 include the hair blower with which a nozzle connects, symbolizing in FIG. 1 the interconnection zone of the invention with the blower by a rectangle.

FIG. 2 depicts one embodiment of, the connecting portion thereof comprising a slotted crenelated circumferential size varying pressure fitting.

FIG. 3 illustrates the connecting portion of one embodiment of the invention comprising an elasticized blower connection sleeve and illustrating intertheaded nozzle (1) parts.

FIG. 4 represents the connecting portion of one embodiment of the invention comprising snap release spring tensioned projections shaped to engage snap release apertures disposed in the dryer.

DESCRIPTION OF THE PREFERRED EMBODIMENT

Figure 1:
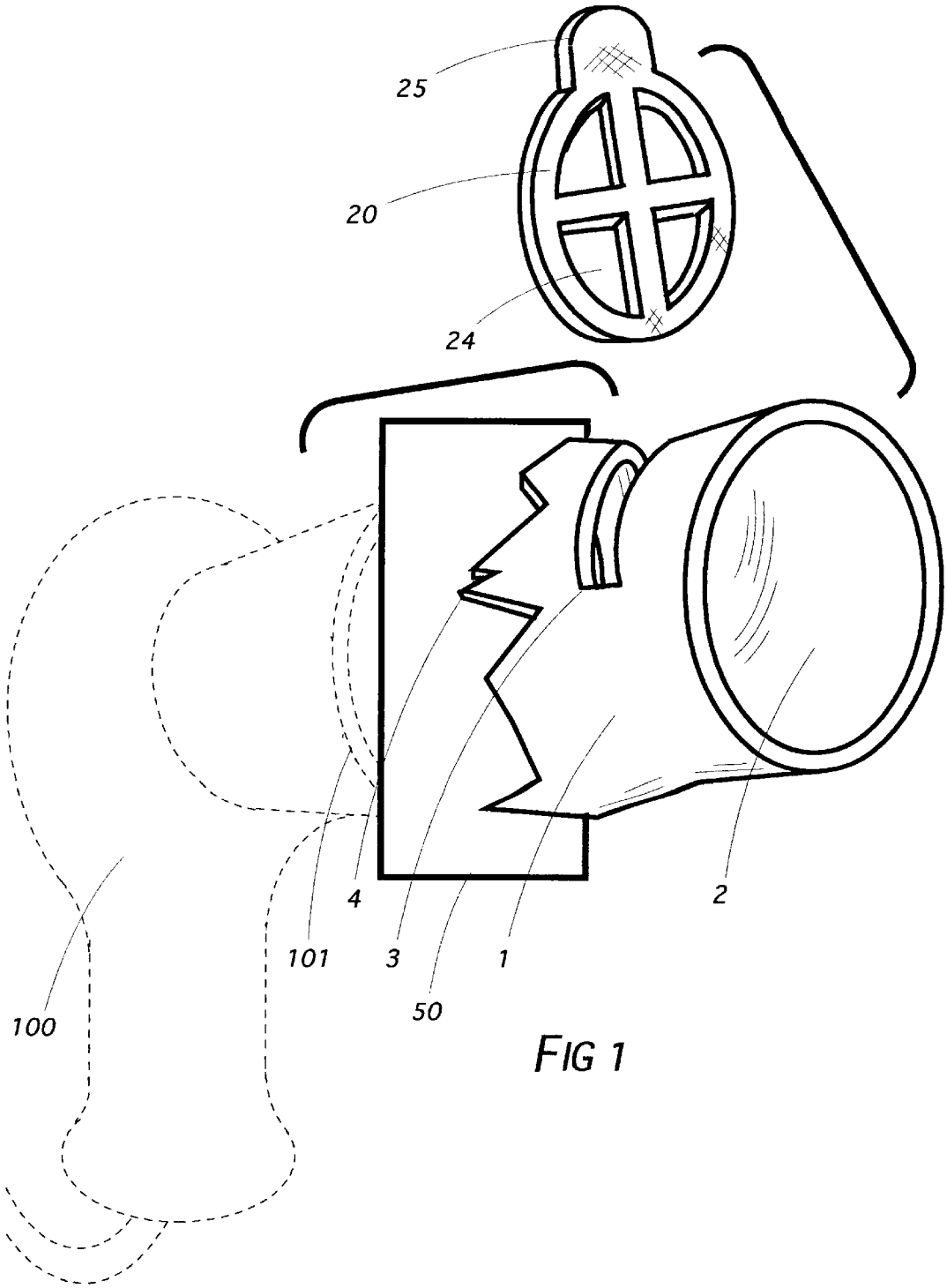
FIGS. 1–4 represent exploded perspective views of various embodiments of the invention.

The invention is configured for emplacement of a capsule upon and removal from the end of a conventional hair blower (100), which part thereof (100) is herein referred to as the blower's effluxive end (101), the end through which airflow—or aeration—occurs. The invention comprises a nozzle (1) within which an impregnation pad (20) saturated with a selected perfume or scent producing effervescent substance—that is, a readily evaporative one—is seated. The hair blower's (100) discharged air absorbs the pad's (20) scent which is then directed by the operator into the object of the blower's (100) operation—a subject's hair or a pet's fur. The invention is, therefore, referred to as a scent charged aeration capsule assembly. The word charged refers to the perfumed impregnation the pad (20) undergoes during manufacture or otherwise during emplacement. The phrase aeration capsule merely pertains to the fact that in operation, the stream of air emanating from the blower (100) enters the nozzle's duct (2), thereby injecting it with a flow of air—that is, aerating it. The word assembly refers partly to the fact that in all but the one-piece embodiment thereof, the invention comprises a combination of one unit—the nozzle (1)—with a second—the hair blower (100). In most embodiments, however, an assembly occurs by reason of the emplacement of the pad (20) or pad frame (21) into the nozzle's emplacement slot (3), permitting it to extend into what is referred to herein as the nozzle's emplacement chamber (13), the portion of the nozzle duct (2) in which the pad (20) is disposed when in use. In other embodiments, the assembly occurs by reason of impingement, or clamping, of the pad (20) or pad frame (27) either between the nozzle (1) and the hair blower's effluxive end (101) or between first and second nozzle parts (10, 11, respectively).

The device would be typically constructed of heat resistant durable material, such as a suitable plastic, and its emplacement upon the hair blower (100) accomplished by any means known in the prior art and further discussed ante. Connection is made at the blower's effluxive end (101)—that from which the driven airflow issues.

There are two points of connection discussed herein which concern all but one embodiment of the invention. It is immediately apparent that most embodiments of the invention itself must be connected to the hair blower (100). That is one point of connection. However, the scented pad (20) or a frame (21) the pad (20) connects to are emplaced within the nozzle (1) and in some embodiments, seated at a second distinct point of connection between two separate parts (10, 11) of the nozzle (1). The means of connection in either case adopt known prior art structures and this application is not intended to be interpreted so as to limit the means of connection. Any configuration employed in prior art to fasten two pipe-like structures together, for example, may also comprise the invention's means of joining at either of the two points of connection referred to herein. Some readily apparent connection means are discussed herein and shown in the drawings. Not every conceivable connection means, however, can be addressed herein with practicality and FIG. 1, therefore, depicts merely a rectangle representing the interconnection zone (50), indicating that any prior art connection means may be employed. Any connection means employed, however, must accommodate well the temperature of the blower's (100) airflow.

One readily apparent example of connection of the invention to the blower (100) comprises a spring laden snap release system comprising in turn a snap release spring tensioned projection (6) and a snap release aperture (7). Other examples comprise coupling threads (5) and certain embodiments of circumferential size varying pressure fittings, including an elasticized blower connection sleeve (8), a slotted circumferential sleeve (9), or the telescoping of tubular parts, of which a hair blower's effluxive end (101) and the nozzle's blower connecting end (4) may be enjoined. Where the joining of the invention to the effluxive end (101) of an already extant blower (100) is concerned, the employment of spring laden snap releases (7) requires modification of the effluxive joining end (101) of the blower (100). Other means of connection (8, 9) need not.

One well established prior art means of connection comprises interthreading, in which the nozzle's blower connecting end (4) and the blower's effluxive end (101) comprise mated coupling threads (5)—that is, the external threads of one of the tubular parts (i.e., 4, 101) are of size permitting interthreading with the internal threads of the other (i.e., 101, 4). This illustrates a second instance in which for connection of the invention to the hair blower's effluxive end (101), the latter (101) would have to be modified. The disposition of mated threading upon both the nozzle (1) and the hair dryer (100) is feasible in instances in which both the blower (100) and the invention are manufactured deliberately for complementary use. In instances in which the invention is manufactured for use with already extant hair blowers (100), the adoption of other means of connection, such as those mentioned supra, (8, 9) might be uneconomical in manufacture. However, there are existing manufacturing retrofitting techniques which may be employed to compress or otherwise connect a threaded ring around a blower's effluxive end (101).

By the term spring laden snap release system is meant a well known prior art connection device comprising projections (6)—usually two disposed to oppose one another—permitted to be snapped into place by tensioned spring action as the tubular parts are telescoped together—that is, as one tubular part is inserted into the other. This type of fitting may be observed upon the standard or pole of a beach umbrella where spring tensioned projections (6) upon the exterior of an inner telescoping tube snap into place within apertures (7) cut into the outer tube, the apertures (7) conforming in shape and size to the projections (6). Separation of the tubular standard is accomplished merely by depressing the projections (6), releasing them from their respective apertures (7). Again, where the invention's connection to the blower's effluxive end (101) is concerned, the latter (101) must be modified in that appropriately shaped and sized apertures (7) must be cut to accommodate the spring tensioned projections (6) protruding from the nozzle (1).

A particular type of snap release system may also be observed on collapsible telescoping tent poles for which the rings connected to a first tubular section impinge upon a second one when twisted or rotated upon it, in which the snap release projection (6) of one tube comprises a pin and the release aperture (7) comprises a small opening in the second tube.

The snap release system's configuration could be reversed, of course, with the projections (6) disposed upon the blower's effluxive end (101) and the accommodating apertures (7) in the invention's duct (2). While such configuration would be suitable for a newly manufactured assembly, the invention contemplates, preferably, connection to any one of several existing hair blowers (100), for which the simplest of the two such modifications would comprise the forming of the apertures (7) therein (100). It should be recognized also that either metal or plastic may be configured so that a piece providing the spring tensioning character may also be that which comprises the projection (6)—as, for example, would be the case with an elongated S shape extending in springboard-like fashion from a point of the blower connecting end of the nozzle (4).

Circumferential size varying pressure fittings are also well known. By such configuration, two tubular structures may be temporarily connected end-to-end in a generally acceptable manner. The outer diameter of the inside tube must be smaller than the inner diameter of the outside one into which it is fitted. In one type of such fitting, the inner tube's outer diameter slopes inward, the tube's diameter decreasing slightly along a gradient toward its end. Similarly, the outer tube's inner diameter increases slightly along a gradient toward its end. The former is easily inserted into the latter and the two are pushed together to form a tight fit which, nevertheless, permits of easy separation. This type of prior art connection may be observed, for example, on some vacuum cleaner wand extensions. Where the invention's connection to the hair blower's effluxive end (101) is concerned, modification upon the blower (100) is necessary for this connection, since the effluxive end (101) thereof (100) must be tapered to either enlarge or diminish toward its end, depending upon the configuration of the invention's nozzle (1) it must complement.

Figure 2:
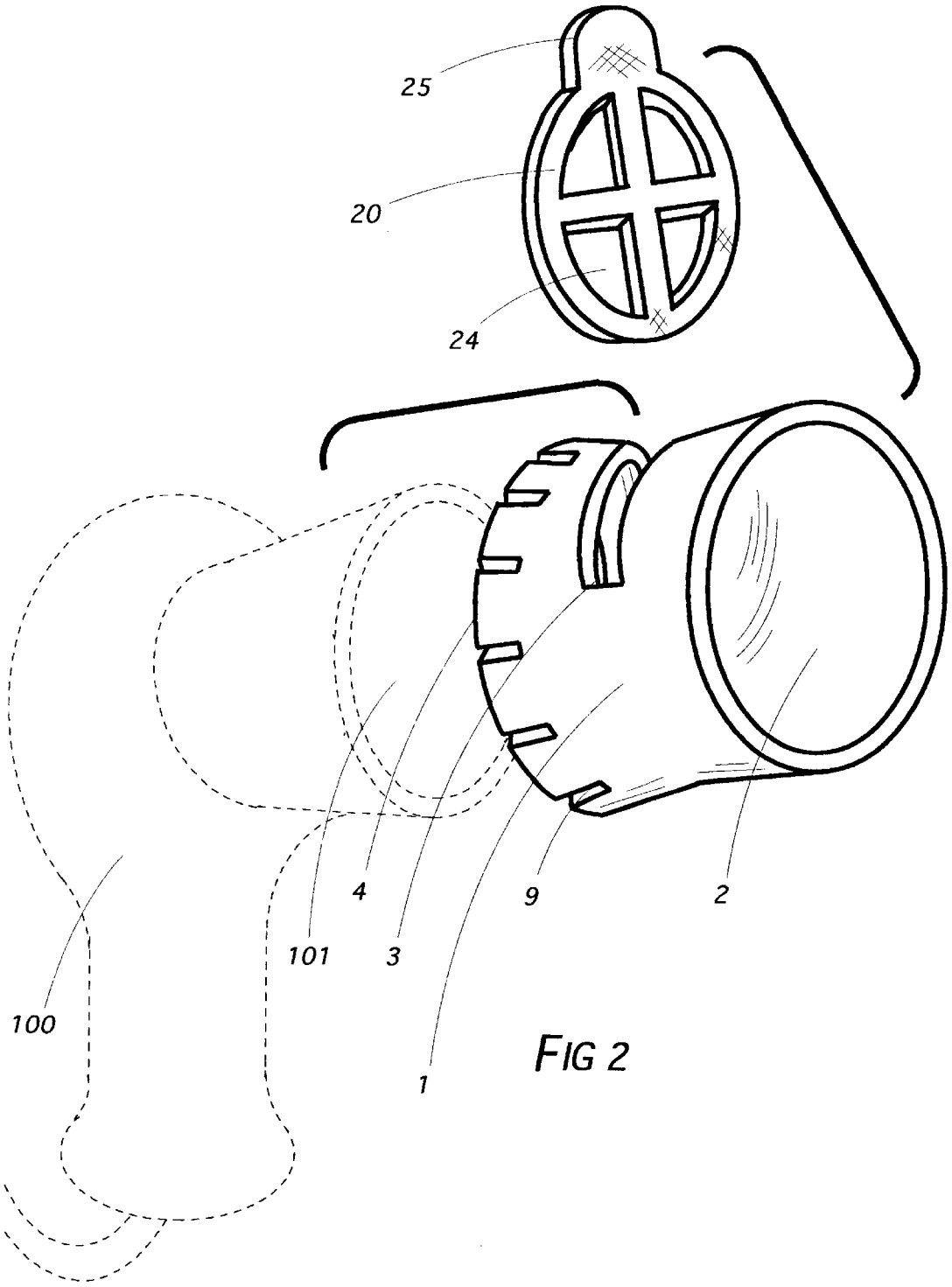

Not all circumferential size varying pressure fittings require modification upon the blower (100), however. FIG. 2 depicts such a connection (9) in which the nozzle's blower connecting end (4) has been crenelated to permit the end (4) to expand when forced outward upon interconnection with the blower's effluxive end (101). Such (9) is one of the preferred configurations where interconnection with an extant blower (100) is contemplated.

Figure 3:
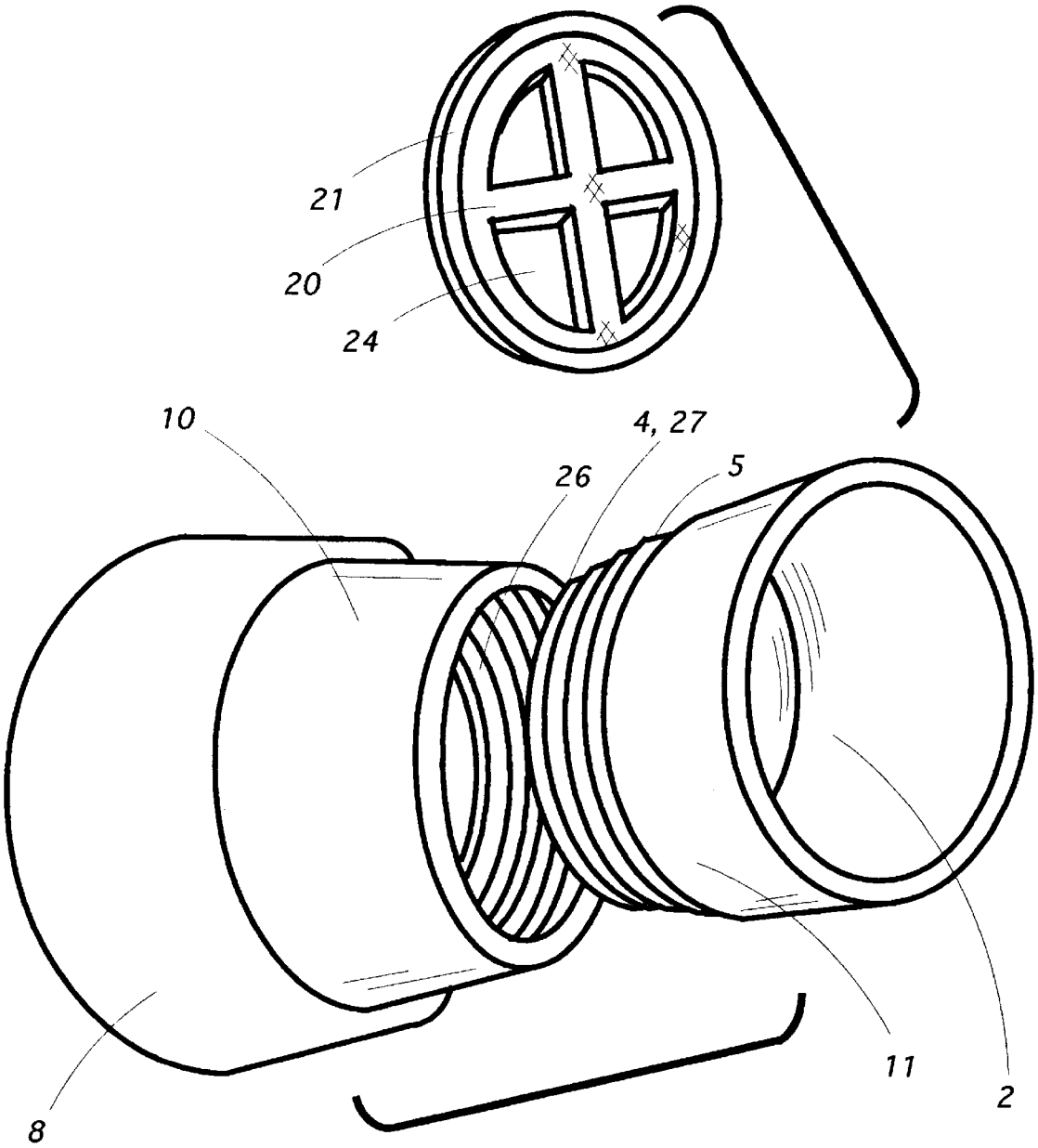

The nozzle (1) may also be configured to connect to a blower (100) in another manner requiring no modification at the blower's effluxive end (101). Like the slotted circumferential size varying pressure fitting (9), an elasticized blower connection sleeve (8) is highly preferred as a connection. The nozzle's blower connecting end (4) comprises an elastic character, such as rubber or similar material would provide, and is merely made to slide over and grip the blower's effluxive end (101) snugly by elastic compression. Such a connector (9) is shown in FIG. 3. Its (9) composition should, of course, be heat resistant.

A fragrance impregnated, or scented, pad (20)—often referred to herein merely as pad (20)—is seated within the nozzle (1) so that the air expelled from the blower's effluxive end (101) and, therefore, through the nozzle's duct (2), passes through it (20). The pad's (20) circumference conforms generally to the inner surface of the duct (2). It is preferable, although not essential, that the pad (20) be disposed along a cross section of the nozzle (1).

Figure 4:
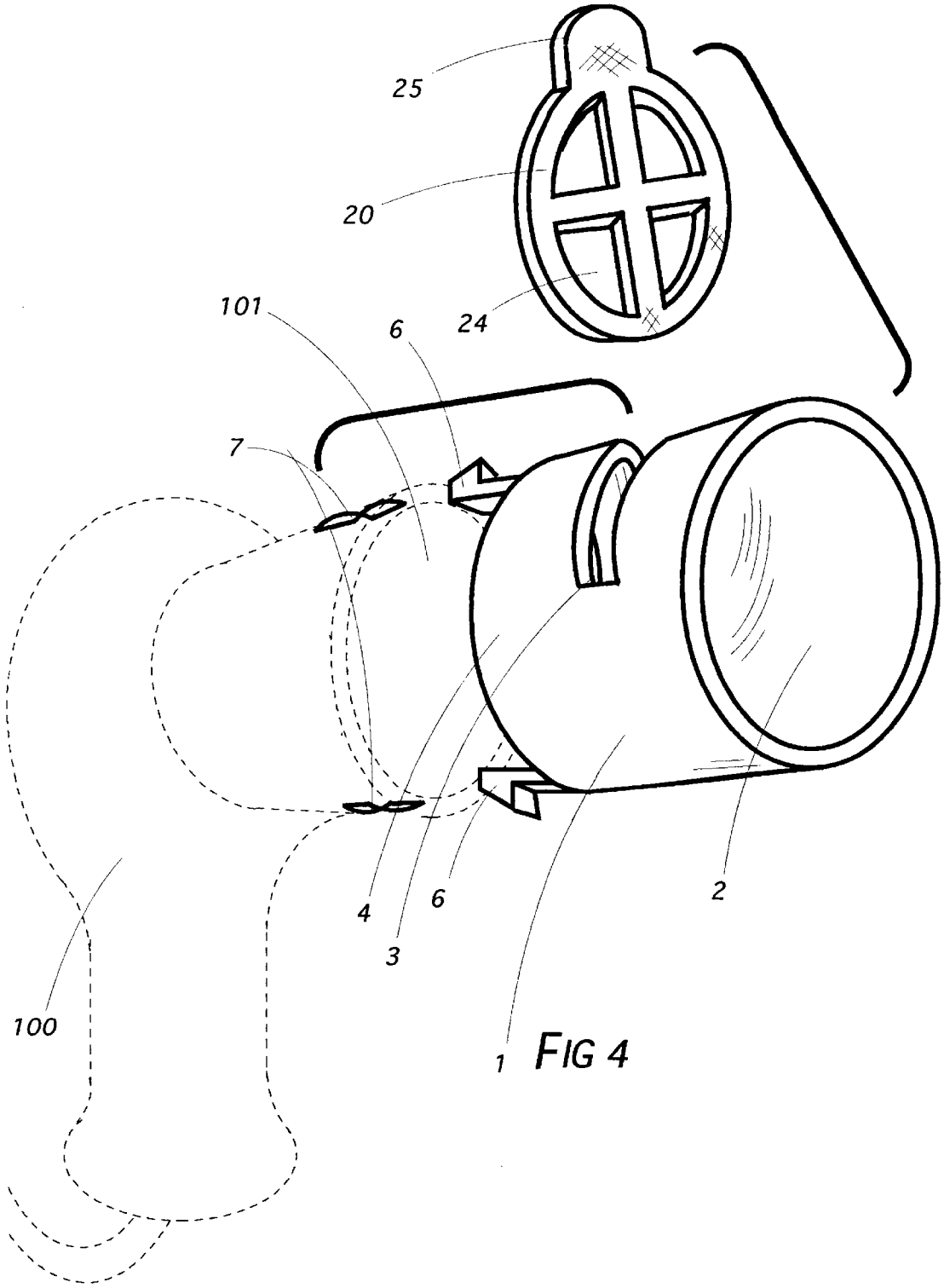

The pad (20) is said herein to be operably inserted into a pad emplacement slot (3) comprising an aperture in the nozzle (1) wide enough to conveniently accommodate the pad (20), as shown in FIGS. 1, 2, 4 and 11. The term operably refers to the blower (100) operator's manipulations in selecting a suitable pad (20) and inserting it into the emplacement chamber (3) of the nozzle (1). The width of the emplacement chamber (3) should also accommodate a pad frame (21) where one (21) is employed. Like the pad (20), the pad frame (21) is preferably generally disposed along a cross section of the nozzle (1). Specifically, the slot (3) is formed such that it is disposed along an upper semicircumference of the nozzle, transversely to the discharged air as shown in FIGS. 1, 2 and 4.

In many embodiments, the pad (20) is shaped so as to comprise a handle (25). It (25) comprises convenient means of holding the pad (20) so as to emplace it or withdraw it from the emplacement chamber (3). A preferred embodiment comprises nothing more than investing the pad (20) with an outward ear (25) or protrusion (25) from its (20) body large enough to provide the operator a finger hold. In embodiments comprising a pad frame (21), ante, the frame (21), also, may comprise a handle (25) and for purposes of definition, the term pad handle (25) includes such a structure on a pad frame (21) as well as on the pad itself (20).

In some embodiments, the pad (20) is fitted within a frame (21), a part of which seats within the nozzle's duct (2). A frame (21) is emplaced within the emplacement chamber (3) in the same manner as with an unframed pad (20). The pad (20) is preferably retained rigidly so as not be become dislodged when the airflow passes through it (20)—that is, when aeration occurs. A variety of means to accomplish such configuration are known to the prior art. The pad (20) may be fixed to its frame (21) with an adhesive, by stapling it (20) with an overlying binder (22) to hold it (20) in place or by sandwiching it (20) between companion frame parts (23) which are made to snap together or otherwise fit with one another in an acceptable manner known to the prior art. A pad (20) may, thus, be manufactured fitted in such secure manner within its frame (21) or it (20) may be emplaced within an existing manufactured frame (21) snapped together by the operator. In the former case, the pad (20) and frame (21) together are disposable and must be replaced. In the latter case, it is only the pad (20) itself which is disposable and requires replacement. The latter is preferred from an environmental point of view. In that embodiment, a given pad (20) scented with a particular fragrance may be selected and operably emplaced within the pad frame (21) before emplacement thereof (20, 21) within the nozzle (1). After use, they (20, 21) may be operably withdrawn in the same manner for storage or disposal. While the pad (20) and frame (21) are essential elements thereof, the invention does not contemplate limitation merely to one or the other of the examples of means of connecting the pad (20) within the frame (21).

Figure 5:
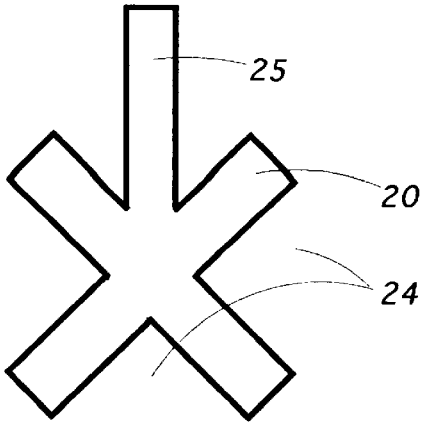
FIGS. 5–8 illustrate variously shaped embodiments of fragrance impregnated, or scented, pads.
Figure 6:
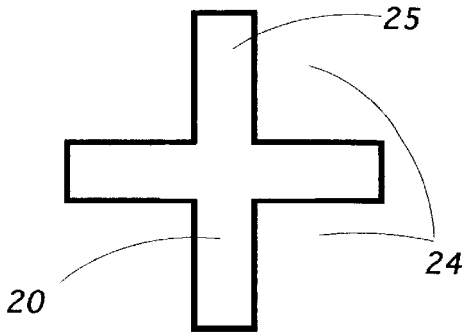
Figure 7:
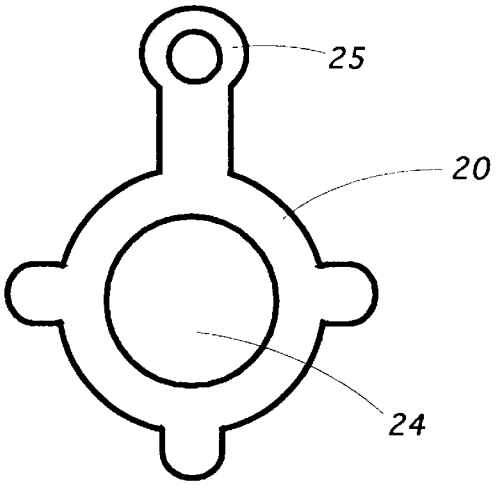
Figure 8:
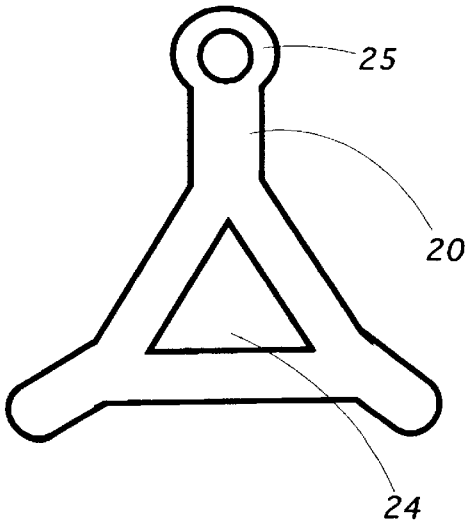
Figure 9:
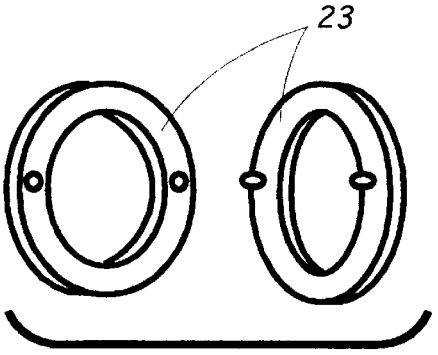
FIGS. 9 and 10 depict two embodiments of pad frames, that of FIG. 9 comprising companion frame parts configured to clamp together.

The pad (20) itself may disk shaped, its (20) circumference conforming to the inner circumference of the nozzle duct (2). Thus, all of the blower's airflow would be required to pass through its (20) thickness. There are instances, however, in which it may be desired that some unscented air effuse along with that which is scented by its passage. In those instances in which lesser airflow scenting is sought, a pad (20) whose circumference conforms only partly with that of the inner surface of the nozzle duct (2) may be provided for. In such embodiments, the circumference of the pad frame (21) may conform in shape to the inner surface of the nozzle duct (2) while, as in FIG. 10, the pad itself might comprise a pad opening (24) within the frame (21). The pad (20) itself may also comprise openings within it (20) such as shown in FIGS. 5, 6.

The phrase means of retention of the pad (20) or pad frame (21) within the nozzle (1) refers to structure which provides for physically securing the pad (20) or any frame (21) the pad is disposed in. The means of retention in some embodiments comprises nothing more than limiting the size of the emplacement chamber (3) so that the pad (20) or frame (21) snugly fits within it (3). Such a structure facilitates their (20, 21) emplacement and withdrawal. However, where the duration of their (20, 21) continued use is contemplated, the pad (20) or frame (21) may be seated more deeply within the nozzle (1). The various types of joining first and second nozzle parts (10, 11, respectively) discussed supra concerning embodiments in which the invention includes a second point of connection are examples of such means of retention. In such embodiments, the pad (20) is impinged between a pad compression plate (29) and a pad seat (28), durable shouldered structures well known to prior art.

In the main, this application addresses embodiments of the invention comprising an emplacement slot (3). Some embodiments, however, entails emplacement of the pad (20) or pad frame (21) between the nozzle (1) and the blower's effluxive end (101) such that when the those two (1, 101) are connected, the pad (20) or frame (21), if present, is snugly clamped in place without the necessity of cutting an emplacement slot (3) into the nozzle (1) or separating it (1) into first and second parts (10, 11). In such configuration, although the necessity of carving out an emplacement slot (3) is obviated, for purposes of this application and by way of definition, it is considered although an emplacement slot (3) is absent, an emplacement chamber (13) is nevertheless present, having been formed—or disposed—at the situs of connection between the nozzle (1) and the blower end (101).

Figure 10:
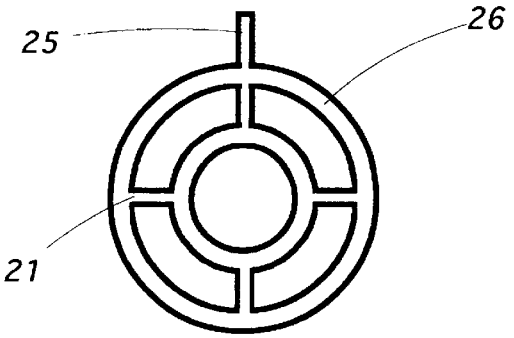

Preferably, the frame (21) might comprise an outer frame referred to herein as a securing stop (26) with an inner frame (27) attached to it within which the entirety of the pad (20) is fitted. FIG. 10 illustrates one such embodiment. In those embodiments in which it (26) is present, the securing stop (26) comprises part of the means of retention discussed herein.

With or without a pad frame (21), the invention contemplates availability of an assortment of pads (20) which might be selected from for emplacement within the nozzle (1) for one operation or another. Where a pad frame (21) is present, any number of properly shaped pads (20) may be interchanged with one another.

Because the pads (20) are impregnated—that is, scented or charged—with perfume, an effervescent fragrance susceptible of loss of potency upon exposure to air, it is preferable they be marketed and stored, whether framed or unframed, in airtight packages.

The seating of a pad (21) or pad frame (20) within the nozzle (1), or between it (1) and the blower's effluxive end (101), where such is the case, may comprise means of retention of the pad (20) or frame (21) therein. The phrase means of retention merely means that the pad (20) or frame (21) and pad (20) combination are securely held in place after emplacement without the necessity of attachment within the nozzle (1). Examples provided supra concerning the second point of connection may comprise such retention means. The connection may be accomplished by any one of several means known to the prior art and include the three exemplary types of connection discussed supra. An interthreaded connection—or one comprising coupling threads (5)—is depicted in FIG. 3.

Since pad (20) interchangeability is contemplated in use, it is preferable that the seating of the frame (21) be such as to permit expedient removal or withdrawal from the emplacement slot (3). If interthreading of parts is adopted as the means of joining, mated threads would be formed both upon a first nozzle part (10) comprising a seat and a second nozzle part (11) comprising a pad compression plate (29), the two parts interthreading to sandwich the pad frame (21) between the plate (11) and the seat (10). This configuration is illustrated in FIG. 3.

Spring tensioned projections (6) may be employed in two ways for the purpose of securing the pad frame (21) within the nozzle (1). Such connection means may be employed to join first and second nozzle parts (10, 11, respectfully), with the pad frame (21) sandwiched in place between them (10, 11). However, the frame (21) may itself be configured to snap into an apertured place by means of such spring tensioned projections (6).

A circumferential size varying pressure fitting (9), supra, might also be used in two ways. Such a fitting may be employed for the connection between first and second nozzle parts (10, 11, respectively) to sandwich the pad frame (21) in place or the pad frame itself (21) may be constructed with a slope which allows the circumference of one of the parts (10, 11) to decrease toward its (21) end, permitting a suitable fit upon insertion into an oppositely interior sloped nozzle duct (2). As was the case with means of connection of the invention to the blower's effluxive end (101), supra, any connection strategy recognized at prior art may be employed as the means of retaining the pad (20) or its frame (21).

Figure 11:
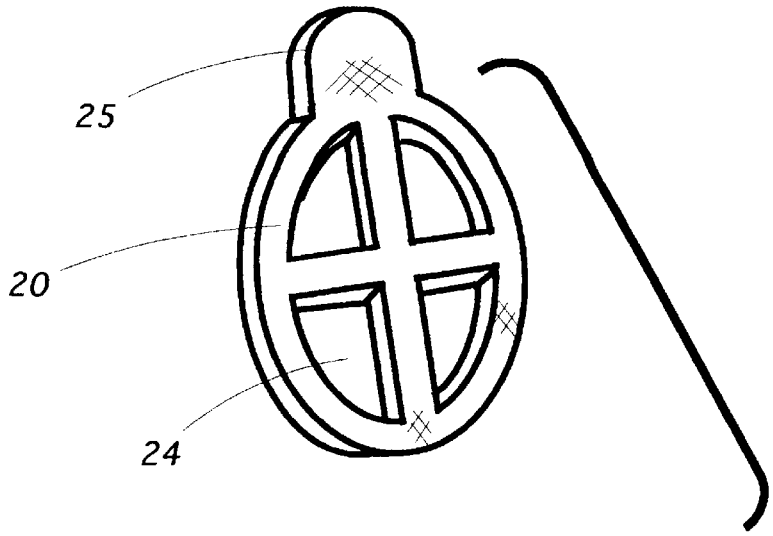
FIG. 11 depicts a one-piece embodiment of the invention made possible by modifying an existing hair blower or by manufacturing a new one.
Figure 11:
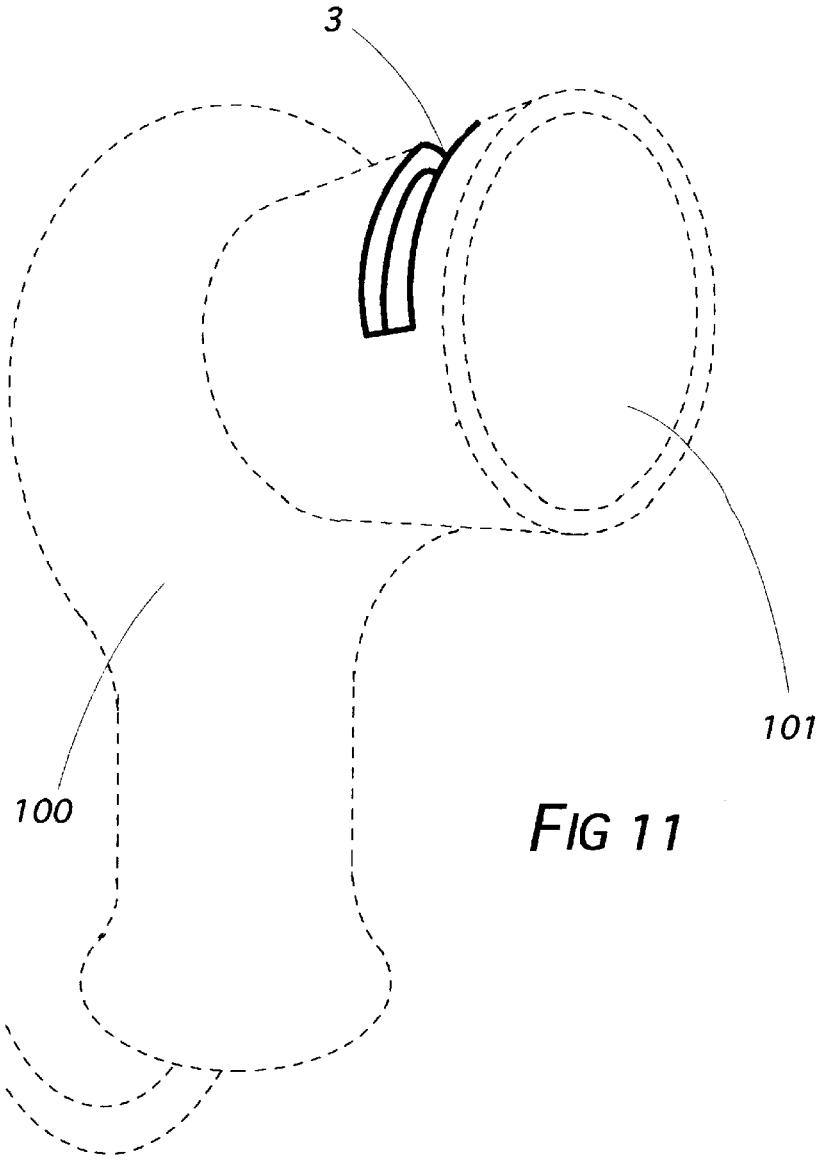

While the focus of this application addresses the interconnection of two objects—a nozzle (1) and an existing hair blower (100)—the invention also contemplates merely the manufacture of a blower (100) or modification of an existing one (100) which permits it (100) to itself accommodate an impregnated pad (20) or pad frame (21) encompassing one (20) which may be emplaced within its effluxive end (101), preferably along a cross section thereof. Specifically, the slot (3) is formed such that it is disposed along an upper semicircumference of the blower's effluxive end (101), transversely to the discharged air as shown in FIG. 11. It should be readily apparent that the mere cutting of an emplacement slot (3) therein (101) thereby converts the blower into a conveniently improved appliance. While it is preferable to avoid modification of an extant blower (100) and instead provide for the invention's connection to it (100), a one-piece embodiment of blower (100) as shown in FIG. 11, an inventive improvement, may expeditiously be the product of original manufacture.

The inventor hereby claims:

1. A scent charged aeration capsule assembly comprising:

a nozzle connected to the effluxive end of a hair blower; and a pad;

the nozzle comprising in turn a pad emplacement slot wherein the pad may operably be emplaced;

the pad comprising in turn an impregnated effervescent fragrance disposed therein; whereby air discharged from the hair blower and ducted into the nozzle through the fragrance impregnated pad within it may be operably directed into a subject's hair.

2. The scent charged aeration capsule assembly according to claim 1 wherein the pad emplacement slot is disposed along an upper semicircumference of a cross section of the nozzle wherein the pad is seated transversely to the discharged air.

3. The scent charged aeration capsule assembly according to claim 1 wherein the pad is further disposed within a frame operably emplaced through the nozzle's emplacement slot:

whereby the pad's disposition is made rigid.

4. The scent charged aeration capsule assembly according to claim 3 wherein a selected pad may be operably emplaced within the pad frame before emplacement within the nozzle and thereafter operably withdrawn therefrom.

5. The scent charged aeration capsule assembly according to claim 1 further comprising a pad handle, whereby convenience in the pad's emplacement and removal through the emplacement slot is enhanced.

6. The scent charged aeration capsule assembly according to claim 4 wherein the pad frame comprises two separable parts between which the pad is retained by circumferential impingement.

7. A scent charged aeration capsule assembly comprising:

a nozzle connected to the effluxive end of a hair blower; and a pad;

the nozzle comprising in turn a pad emplacement chamber wherein the pad may operably be emplaced;

the pad comprising in turn:

an impregnated effervescent fragrance disposed therein; and a pad handle;

whereby air discharged from the hair blower and ducted into the nozzle through the fragrance impregnated pad within it may be operably directed into a subject's hair and convenience in the pad's emplacement and removal from the emplacement chamber is enhanced.

8. An improved hair blower, the blower's effluxive end comprising an emplacement slot formed therein along an upper semicircumference thereof transverse to the air discharged therefrom wherein a pad is operably emplaced;

the pad comprising in turn an impregnated effervescent fragrance disposed therein;

whereby air discharged from the hair blower and operably directed into a subject's hair first passes through the fragrance impregnated pad within the hair blower's effluxive end.

9. The improved hair blower according to claim 8 wherein the pad emplacement slot's width exceeds that of a pad frame within which a pad is disposed.

10. A scent charged aeration capsule assembly comprising:

a nozzle connected to the effluxive end of a hair blower, the means of connection comprising one of:

interthreading;

a spring laden snap release system; and a circumferential size varying pressure fitting;

the capsule assembly further comprising a pad transversely disposed along a cross section between the effluxive end of the blower and retained thereat by circumferential impingement between the blower's effluxive end and the nozzle.

11. The scent charged aeration capsule assembly according to claim 10 wherein the pad is disposed within a frame transversely disposed along a cross section between the effluxive end of the blower and retained thereat by circumferential impingement between the blower's effluxive end and the nozzle.

* * * * *